US012448087B2

(12) United States Patent
Millar

(10) Patent No.: US 12,448,087 B2
(45) Date of Patent: Oct. 21, 2025

(54) MEANS FOR REMOVABLY INSTALLING FINS ON A BOARD FOR USE IN WATER SPORTS

(71) Applicant: Russell John Millar, Wellington (NZ)

(72) Inventor: Russell John Millar, Wellington (NZ)

(73) Assignee: FUTURES FINS, LLC, Huntington Beach, CA (US)

( * ) Notice: Subject to any disclaimer, the term of this patent is extended or adjusted under 35 U.S.C. 154(b) by 653 days.

(21) Appl. No.: 17/784,451

(22) PCT Filed: Dec. 11, 2020

(86) PCT No.: PCT/NZ2020/050172

§ 371 (c)(1),
(2) Date: Jun. 10, 2022

(87) PCT Pub. No.: WO2021/118370

PCT Pub. Date: Jun. 17, 2021

(65) Prior Publication Data

US 2023/0002015 A1 Jan. 5, 2023

(30) Foreign Application Priority Data

Dec. 13, 2019 (NZ) ..... 760154

(51) Int. Cl.
*B63B 32/66* (2020.01)

(52) U.S. Cl.
CPC ..... *B63B 32/66* (2020.02)

(58) Field of Classification Search
CPC ..... B63B 32/66; B63B 32/60
See application file for complete search history.

(56) References Cited

U.S. PATENT DOCUMENTS

2003/0087564 A1 5/2003 Kelley
2006/0035543 A1* 2/2006 English ..... B63B 32/66 114/140
2017/0158294 A1 6/2017 Watson

FOREIGN PATENT DOCUMENTS

| | | |
|---|---|---|
| CN | 204713394 | 10/2015 |
| CN | 106043615 | 10/2016 |
| CN | 104260844 | 4/2017 |
| EP | 0034990 | 9/1981 |

OTHER PUBLICATIONS

Schmitter, Thierry; PCT Written Opinion of International Searching Authority and International Search Report; Apr. 29, 2021; 9 pages; PCT/NZ2020/050172; HV, Rijswijk.

* cited by examiner

*Primary Examiner* — Andrew Polay
(74) *Attorney, Agent, or Firm* — STETINA GARRED BRUCKER & NEWBOLES

(57) ABSTRACT

A mount for removably installing a fin to a board used in water sports such as a surf board, wake board, windsurfing board and stand-up paddle board is provided. The mount is secured within the deck of the board and has a pivoting member pivoting between a locked position, to lock a fin to the board, to an unlocked position where the fin can be removed from the board, under hand pressure. As shown in drawing the pivoting member pivots about a pivot pin. In the unlocked position lug can be disengaged from its complementary recess (such as a notch) in the front end of the base of fin and the fin can be removed from the mount. In the locked operation the fin is fitted into channel and the pivoting member pivoted by hand pressure on a plate to cause lug to engage with notch.

16 Claims, 5 Drawing Sheets

MEANS FOR REMOVABLY INSTALLING FINS ON A BOARD FOR USE IN WATER SPORTS

CROSS-REFERENCE TO RELATED APPLICATIONS

The present application claims priority to PCT International Patent Application No. PCT/NZ2020/050172, filed Dec. 11, 2020, and New Zealand Application No. 760154, filed Dec. 13, 2019, the disclosures of which are incorporated herein by reference.

STATEMENT RE: FEDERALLY SPONSORED RESEARCH/DEVELOPMENT

Not Applicable

BACKGROUND

1. Field of Invention

This invention relates to means for removably installing fins to a board used in water sports such as surfboards, wake boards, wind surfers, and stand up paddleboards.

2. Background

It is known for the tail end of such boards such as a surfboard to have one or more fins. The description in this specification will generally refer to surfboards but it is to be understood that the discussion of any point will also apply to the other boards envisaged by this invention.

Each fin may serve as a hydrofoil to improve stability and control as a surfer steers the board through the water using their feet. Surfboards are sometimes supplied without fins, with the intention that the fins will be purchased separately and retro-fitted. Also, over time fitted fins can become damaged, for example when surfing or transporting surfboards, and need replacement. It is also possible that fins can detach during conditions of adverse use, such as by coming into contact with the ground during surfing such that a fin will detach involuntarily. And, in some cases, it is desirable to change the size or style of fin used depending on wave conditions. Fitting or replacing fins can be problematic in that the process may require the application of significant force or the use of tools.

Object of the Invention

It is an object of preferred forms of the invention to go at least some way towards addressing the above problem. While this applies to at least preferred forms it should be understood that the object of the invention per se is simply to provide a useful choice. Therefore, any benefits or advantages applicable to a preferred embodiment should not be read-in as a limitation on any claims expressed more broadly.

Interpretation

The term "comprising" or related terms such as "comprises" should not be interpreted exclusively. They indicate the minimum features present, without ruling out the option of there being further unspecified features. The "features" may for example be physical parts and/or action steps.

BRIEF SUMMARY

In a first aspect of the invention there is provided a board for use in watersports comprising:

a fin and a deck, a fin mount secured within a cavity in the deck; wherein the fin is secured to the mount, one end of the fin engages the mount in a releasable fit, another part of the fin engages a cam that forms part of the mount, the cam including a pivoting member and being capable of pivoting motion between a locked position, in which the fin is secured in the mount, and an unlocked position where the fin can be removed, the pivoting motion involving a change in the plane of the pivoting member relative to the main plane of the deck, and wherein the cam, when the fin is locked in position, is itself locked to the mount.

The term "cam" is used herein in a general sense to describe an element that moves from one position to another under hand force to operatively engage with another element. The movement can be described as a swinging motion, which can be a rocking or pivoting motion of the first element about a pivot such that the first element then engages with the fin to lock the fin in position with the mount. It is also envisaged that the pivoting motion of the first element can cause a further element which is a cam in the traditional sense to rotate and engage with the end of the fin to lock the fin in place.

Optionally the releasable fit at the first end can be a conventional arrangement such as a tongue and groove fit, such that the fin has a groove that receives a tongue in the mount.

Optionally the tongue and groove fit is at a rear end of the fin and mount.

Optionally the cam is located in the mount at the front end opposite to that of the tongue and groove fit.

Optionally the cam is located between the rear end and the front end of the mount.

Optionally the releasable fit is such as to prevent any vertical movement of the fin during use.

Optionally the cam engages a recess (e.g., a notch) of the fin to lock the fin in place by way of an interference (e.g., friction) fit. Fins are normally provided with such recesses and the cam will include an engagement means complementary to that recess to achieve an effective interference fit to lock the fin in place.

Optionally the cam has a lug that releasably fits into the recess (e.g., notch).

Optionally the cam incorporates a plate that can be pressed on by a finger or thumb or both a finger and a thumb to pivot the plate between positions where the fin is and is not locked to the mount.

Optionally the pressure is exerted on the plate in the same downward direction when causing the rotation of the plate to a locked position as when it causes the rotation of the plate to an unlocked position.

Optionally, when the cam is in the locked position it is held there by an interference (e.g., friction) fit between the pivoting part and a stationary neighbouring part of the mount by at least one projection such as a node on one part and at least one complementary depression for the projection on the other part.

Optionally one or more projections are located on the cam and the complementary depressions are located on a non-rotating neighbouring part of the mount.

Optionally one or more depressions are located on the cam and the complementary projections are located on a non-rotating neighbouring part of the mount.

In an alternative embodiment of the invention there is provided a board fin mount comprising:

a body portion configured to be securable in a cavity in the deck of the board;

one or more elongate slots in the body portion each adapted to removably receive the base or one or more base projections of a board fin;

means for removably receiving a first end of the base or the, or each, base projection of the fin at one end of the, or each, slot; and a cam including a pivoting member, located at another portion of the, or each, slot adapted to pivot to move between a locking locked position, to securely lock the base or the, or each, base projection of the fin, to the mount and an unlocking unlocked position where the base or the or each, base projection of the fin is removable from the mount, wherein the pivotable motion of the pivoting member involves a change in the plane of the pivoting member relative to the plane of the body portion, and wherein the cam is securely lockable to the body portion.

Optionally the cam is at the opposite end of the or each slot.

Optionally the body portion is secured immovably in a cavity in the deck of the board.

Optionally the body portion has projections extending laterally from its external side or end surfaces to anchor the body portion into complementary recesses in the board cavity into which the mount is secured.

Optionally the means for removably securing the first end of the base or the, or each, base projection of the fin to the first end of the, or each, slot comprises a tongue on one part and a complementary groove on the other part.

Optionally the pivoting member includes a projection to lock into a complementary recess (e.g., a notch) provided on the opposite end of the base or the, or each, base projection of the fin.

Optionally the pivoting member further includes a plate for application of force by a finger or thumb, or both finger and thumb, pressure to cause the projection on the pivoting member to move into and out of the recess (e.g., notch) on the fin.

Optionally the projection from the pivoting member is a lug shaped to tightly engage in the recess in the fin.

Optionally the cam is able to be held in a locked position by way of an interference fit between at least one projection (e.g., a node) and complementary depression in a neighbouring surface of the body portion.

In a further aspect of the invention there is provided a board for use in watersports comprising:

a fin and a deck, a fin mount secured within a cavity in the deck, and the fin being releasably secured to the mount, the mount having one or more elongated slots, and the base of the fin or one or more base projections being configured to fit within the or each complementary slot in a releasable fit between one end of the base or base projection and that end of the slot, and the mount having a cam located at another portion of the mount engaging with a complementary portion of the fin base or base projection, the cam having a pivoting member pivotable by downwardly directed finger or thumb or both finger and thumb pressure on the member to move between a locked position in which the fin cannot be removed from the mount and an unlocked position allowing the fin to be removed from the mount.

In a still further aspect of the invention there is provided a board having a deck without any attached fins and having a fin mount comprising a body portion configured to be securable in a cavity in the deck of the board, one or more elongate slots in the body portion adapted to removably receive the base or one or more base projections of a board fin, means for removably receiving a first end of the base or the, or each, base projection of the fin at one end of the, or each, slot and a cam including a pivoting member, located at another portion of the, or each, slot, adapted to pivot to move between a locked position, to securely lock the base or the, or each, base projection of the fin, to the mount, and an unlocked position where the base or the, or each, base projection of the fin is removable from the mount, wherein the pivotable motion of the pivoting member involves a change in the plane of the pivoting member relative to the plane of the body portion, and wherein the cam, when the fin is in the locked position, is itself locked to the body portion.

BRIEF DESCRIPTION OF THE DRAWINGS

Some embodiments of the invention will now be described by way of example and with reference to the accompanying drawings, of which.

DETAILED DESCRIPTION

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

As mentioned above the invention is broadly concerned with boards for use in watersports. The invention will be illustrated by reference to the accompanying drawings in which a surfboard is referred to. It is to be understood that the illustrated embodiments can be also applied to other boards such as wake boards, windsurfing boards and stand up paddleboards.

Figure 1:
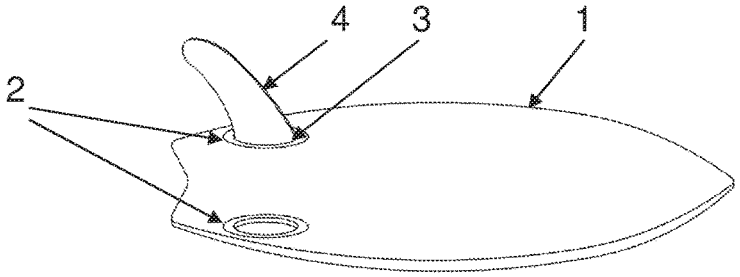
FIG. 1 is a perspective view of a surfboard with a fin installed.

Referring to FIG. 1, the surfboard 1 has cavities 2 on the underside of the deck into each of which a mount, for example a fin box 3, is installed securely such that it will remain in place when the surf board 1 is in use. The fin box 3 is normally secured within the cavities 2 such as by fibreglass as a board is being manufactured. Such conventional processes can be used in this invention.

The box 3 is adapted to receive a surfboard fin 4. In FIG. 1 embodiment the surfboard is designed for two fin boxes and two fins, but in other embodiments there may be one, three, or more.

Figure 2:
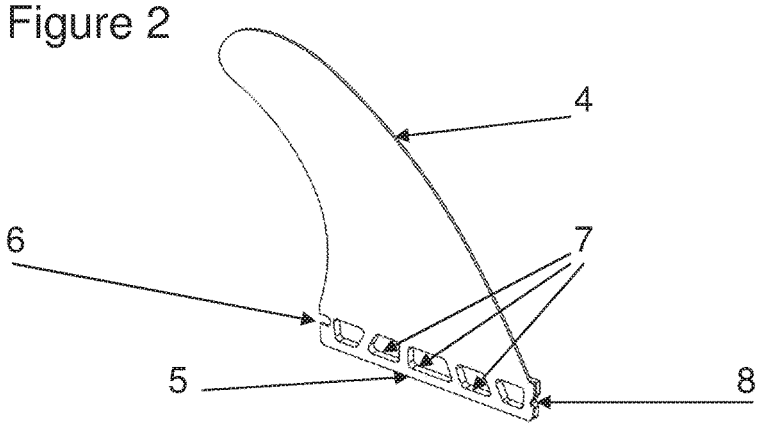
FIG. 2 is a perspective view of the fin.

Referring to FIG. 2, the fin 4 has a base 5 comprising a groove 6 in its rear end, a series of openings 7 and a recess such as a notch 8 in its front end. The notch 8 in fin manufacture is normally 'V' shaped. Other shapes can be provided and the projections on the pivoting member as discussed below will be adjusted to complement the notch shape.

The function of the openings 7 is to reduce the weight of the fin 4.

Some fin designs do not have a continuous base but have two or more projections depending from the base portion of the fin. Each of those projections will have a base portion that engages with a slot in the mount in a similar way.

Figure 3:
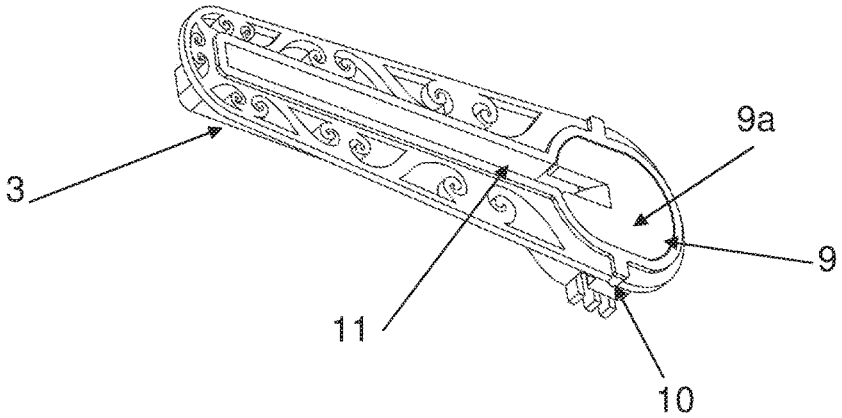
FIG. 3 is a perspective view of a fin box.

Referring to FIG. 3, the fin box 3 has a cam at one end including a pivoting member 9 which includes a pivoting member plate 9*a* for hand force to be applied such as plate 9*a*. The fin box 3 has an elongate slot, for example a channel 11. By hand force is meant that one or more fingers optionally together with a thumb can apply pressure to cause the pivoting member 9 to pivot about a pivot pin 10.

The cam has the pivot pin 10 for allowing the pivoting member 9 to pivot between a locked position as shown to lock the fin 4 in the fin box 3 and thus to the surfboard 1, and a release or unlocked position where the fin 4 can be removed by hand. The pivoting member plate 9*a* has a rearward portion 9*c* and an opposing forward portion 9*b*. The. The cam is designed such that hand force applied to the rearward portion 9*c* of the pivoting member plate 9*a* of the pivoting member 9 in the position shown in FIG. 3 will cause the plate 9*a* to rotate about the pivot pin 10 to a position where the fin 4 is not locked and can be removed. The plate 9*a* locks at a position where a lug 12 in a cam as discussed below is designed to match the position of the notch 8 on the fin 4 when installed.

As shown, the fin box 3 incorporates a Koru design resembling waves. Alternatively other images, designs, brand names or marketing slogans can be incorporated into the box 3.

The pivot pin 10 needs to have sufficient strength to withstand the forces on it when the surfboard 1 is in use. A suitable material is a 316 grade stainless steel pin, 3 mm in diameter.

The fixing of the fin 4 in the fin box 3 is described in more detail with reference to FIGS. 4 and 5 where, for simplicity, the box 3 is illustrated cut away without the stylistic features of FIG. 3.

Figure 4:
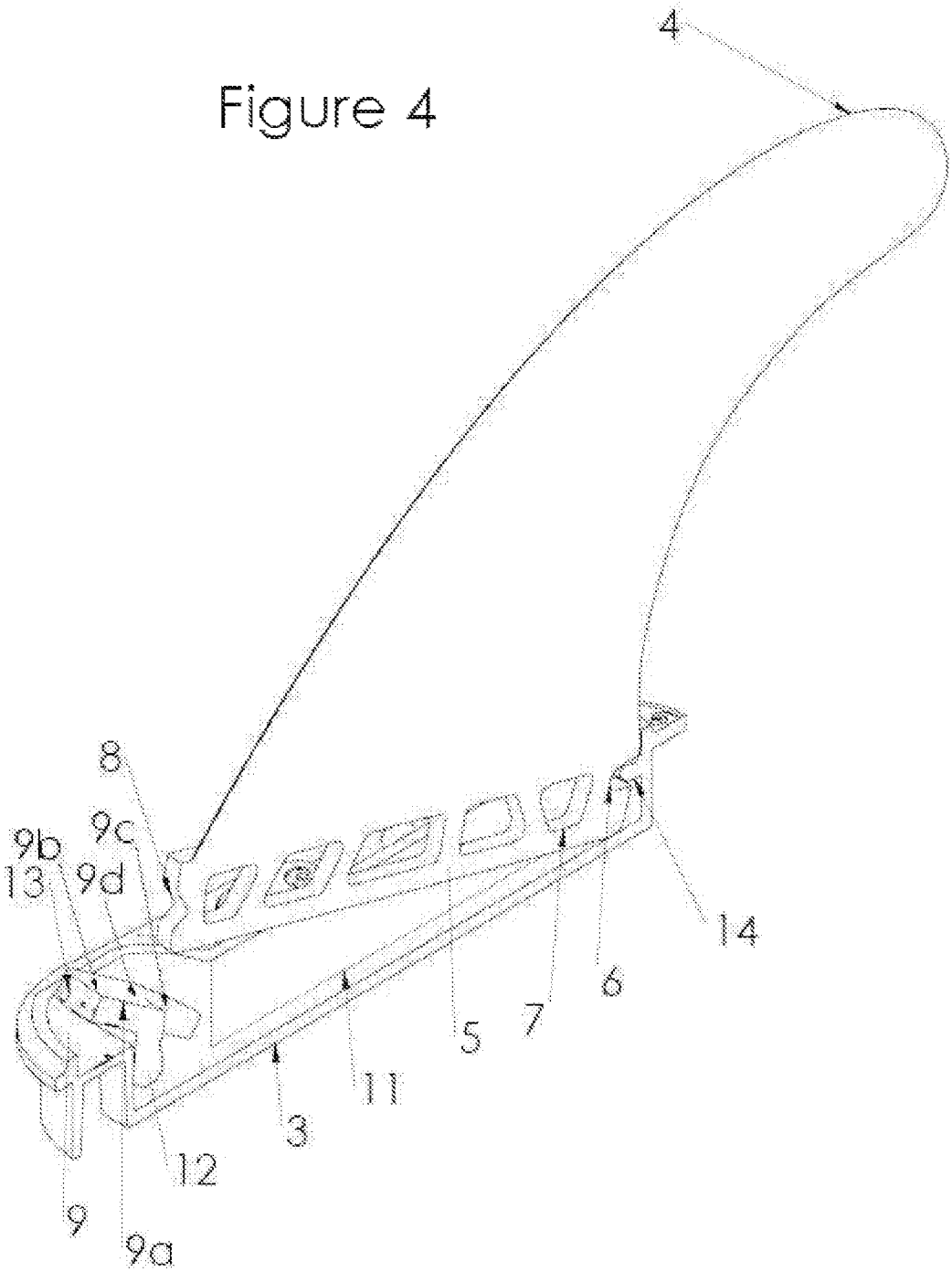
FIG. 4 is a perspective, cutaway view of the box with the fin partially installed.

As shown in FIG. 4, the pivoting member 9 has a projection, such as the lug 12, that extends at a downwards angle from the plate 9*a* away from the top surface 9*d* into the channel 11. The lug 12 has a shape complementary to the fin notch 8.

The plate 9*a* also has a projection such as a raised node 13 on its front edge. and the node 13 is adapted to engage with a complementary depression (not shown) in a neighbouring edge of the fin box 3 when rotated to the locked position.

The lug 12 is preferably integrally moulded with the plate 9*a* from a suitable plastics material. Alternatively, the lug 12 may be made of steel and may not be integral with the plate 9*a*.

The pivoting member 9 can be pivoted to the FIG. 4 position by hand force, for example by pressing down on the rearward portion 9*c* of the pivoting member plate 9*a* with one's finger or thumb or with one or more fingers optionally together with a thumb.

The rear end of the fin's base 5 is positioned in the channel 11 so that the groove 6 fits around a tongue 14 extending from the rear end of the box 3. The rearward portion 9*c* extends towards the tongue 14 and the forward portion 9*b* extends away from the tongue 14. The base 5 of the fin 4 is then moved by a user holding the upper part of the fin 4 so that the front end swings into position resting in the channel 11.

Figure 5:
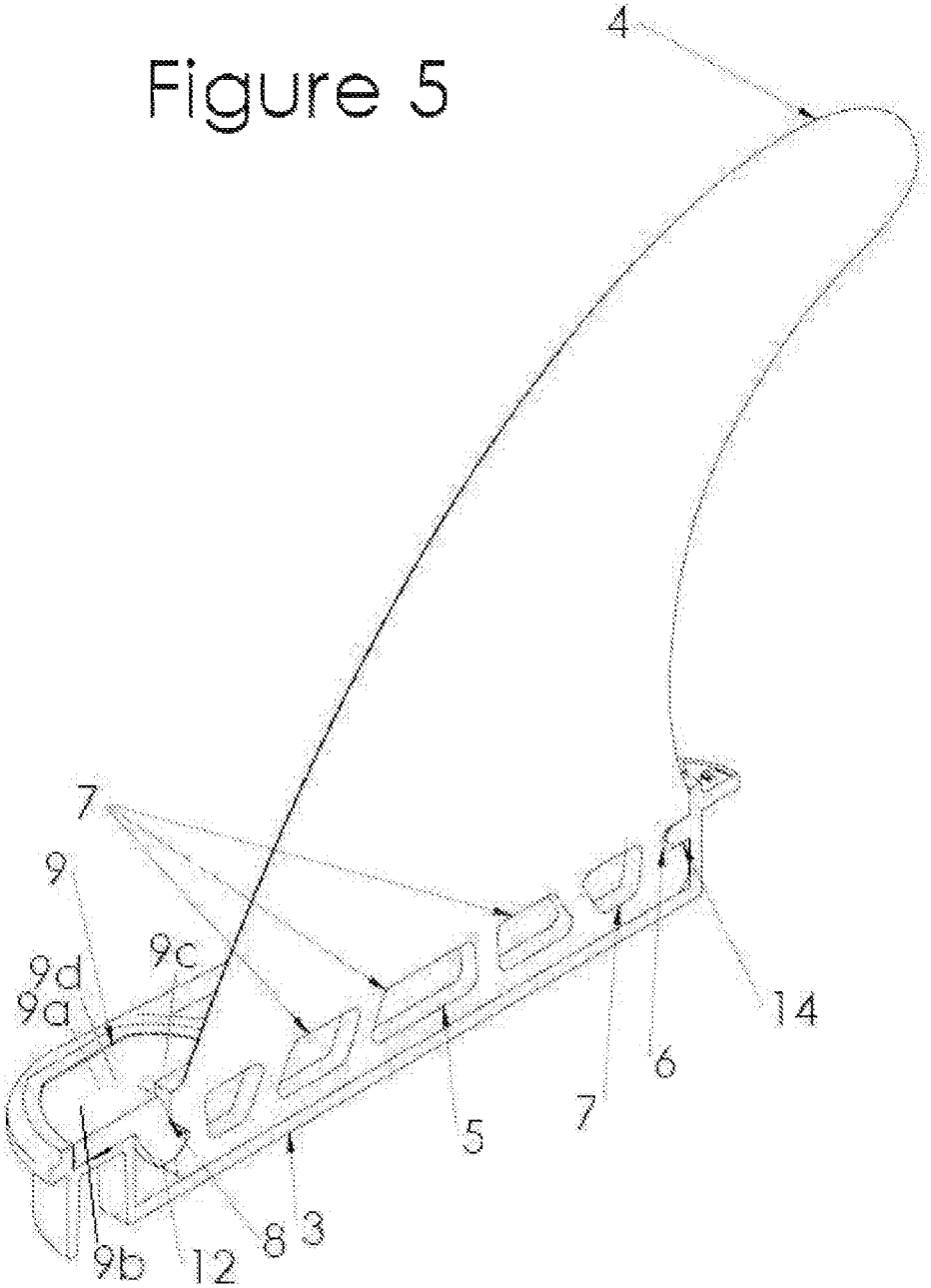
FIG. 5 is a perspective, cutaway view of the box with the fin installed.

Referring to FIG. 5, once the front end of the fin 4 is moved so that the base 5 sits resting within the channel 11, the pivoting member 9 is pivoted by finger or thumb, or at least one finger optionally together with a thumb, pressure on the forward portion 9*b* of the pivoting member plate 9*a*, causing the end of the lug 12 to move into complementary engagement with the notch 8. The lug 12 engages with the forward end of the base 5 and in the notch 8 in a tight fit so that movement of the fin base 5 is prevented.

The top surface 9*d* of the plate 9*a* is flush with the surface of the fin box 3, causing the node 13 to engage with the complementary box depression. The fin 4 is then secure in the box 3 in the locked position. Movement is prevented by the tongue 14 and the groove 6 fit at one end of the box 3, the lug 12 and the recess 8 arrangement at the other, the secure fit of the cam in the fin box 3, the secure fit of the fin box 3 in the channel 11 and the fixing in the locked position of the pivoting member 9 so that further rotation of the pivoting member 9 is prevented.

This is facilitated by an interference fit (for example, friction fit) between the node 13 and the depression. In an alternative embodiment of the invention there may be more than one node 13, for example two or three, and they may be positioned as desired on the pivoting member plate edge surface for engagement each with their own complementary depression.

To remove the fin 4, the process is reversed. The pivoting member 9 is pivoted by sufficient finger or thumb pressure, or a combination thereof as described before, to the unlocked position so that the lug 12 is clear of the notch 8, the user holds the upper end of the fin 4 and pulls at a downward angle it so that the groove 6 is lifted out of engagement with the tongue 14 and the fin 4 is pulled out of the fin box 3.

The pivoting member plate 9*a* in operation is subjected to downward force in a direction towards the channel 11 by finger or thumb pressure, or a combination thereof as described before, both on the forward portion 9*b* to move to a locked position and on the rearward portion 9*c* to then move to an unlocked position. During this movement the plane of the plate 9*a* (which is coplanar with a top surface 9*d* of the pivoting member plate 9*a*) then changes relative to the main plane of the fin box 3 and consequently the deck when installed on the deck.

Figure 6:
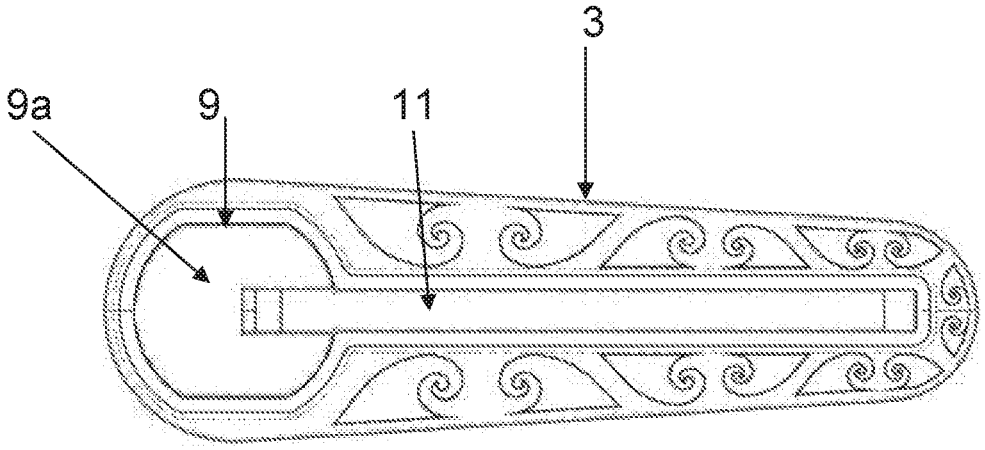
FIG. 6 is a plan view of the box.
Figure 7:
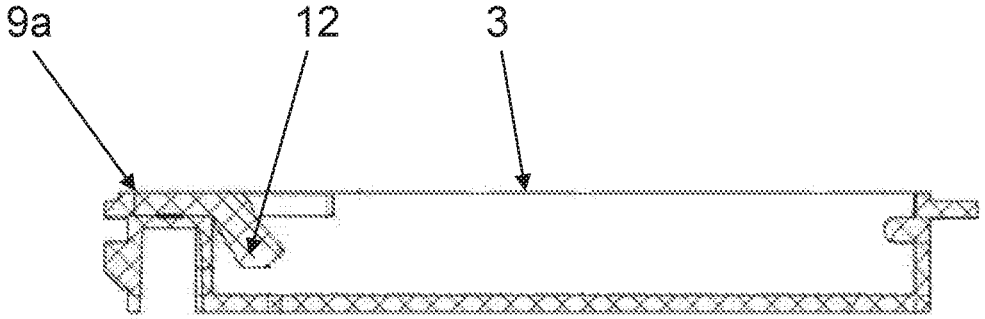
FIG. 7 is a cross section view of the box.

FIGS. 6 and 7 are alternative views of the embodiment of the fin box 3. One embodiment of the cross section of the lug 12 is shown in FIG. 7. The top surface 9*d* of the pivoting member plate 9*a* may be flush with the top of the fin box 3. When present in the cavity 2 in the deck of the surf board 1 the upper surfaces of the fin box 3 may be flush with the under surface of the surf board 1 so that the water flow is not affected in use.

Figure 8:
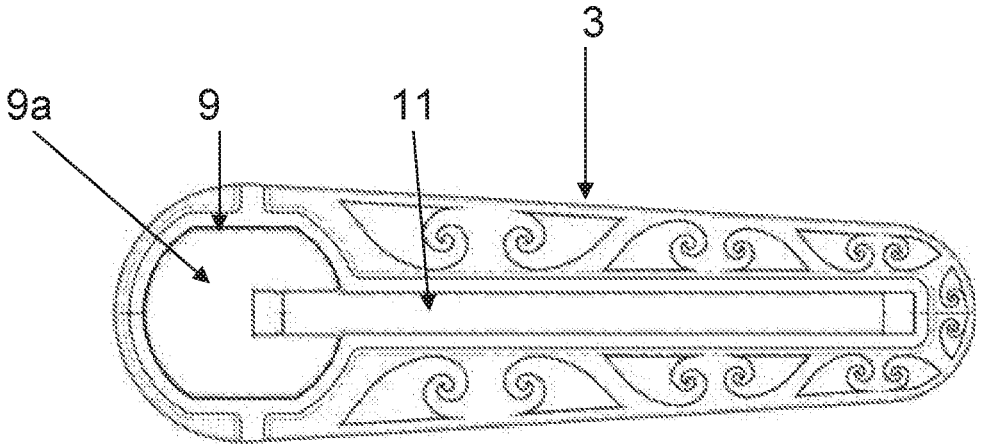
FIG. 8 is a plan view of an alternative embodiment of the box.
Figure 9:
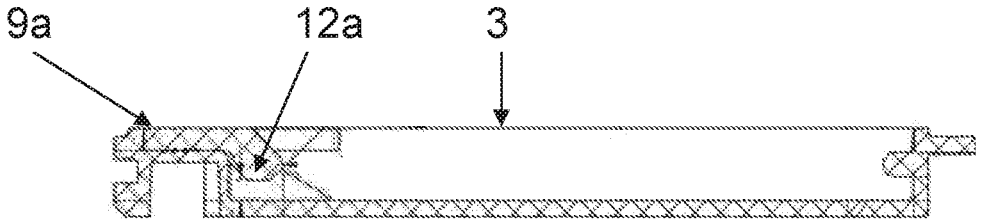
FIG. 9 is a cross section view of an alternative embodiment of the box.

FIGS. 8 and 9 show views of a further alternative embodiment of the fin box 3. In the embodiment shown in FIGS. 8 and 9, the channel 11 is shallower than in the embodiment of FIGS. 6 and 7 and the cam 9 comprises a truncated lug 12*a*. The deeper and shallower versions of the fin box 3 are to allow use with different sized off-the-shelf fins.

In another embodiment the pivoting member plate 9*a* can be spring biased (not shown) to the locked position by a spring.

In all embodiments the cavity 2 in which the lug 12 of the pivoting member 9 moves is desirably kept to a minimum size to allow for it to operate effectively but to reduce the opportunity for foreign substances such as sand to collect in it.

In terms of disclosure, this document hereby anticipates and discloses any feature mentioned herein in combination with any one or more other features mentioned herein, even if such combination is not the subject of a claim.

Furthermore, while the invention has been illustrated by reference to specific features, it is not to be construed as being limited thereto.

The invention clearly has industrial applicability. Many millions of boards for use in watersports are manufactured and sold annually which in use will require regular fin replacement. There is also a specific, credible and substantial use for the invention permitting a fin to be replaced on a board without the need for a user to carry an implement to remove the fin.

INDUSTRIAL APPLICABILITY

The invention clearly has industrial applicability. Many millions of boards for use in watersports are manufactured and sold annually which in use will require regular fin replacement.

UTILITY

There is also a specific, credible and substantial use for the invention permitting a fin to be replaced on a board without the need for a user to carry an implement to remove the fin.

The invention claimed is:

1. A board for use in watersports comprising:

a fin and a deck, the fin having a groove, a fin mount secured within a cavity in the deck, the fin mount having a tongue, wherein the fin is secured to the fin mount, one end of the fin engages with the mount in a releasable fit, the releasable fit being a tongue and groove fit with the groove receiving the tongue, another part of the fin engages with a cam that forms part of the fin mount, the cam including a pivoting member and being capable of pivoting motion between a locked position, in which the fin is secured in the fin mount, and an unlocked position where the fin can be removed, the cam including a plate from which the pivoting member depends downwardly and wherein the plate can be pressed by a finger or thumb to pivot the plate to move between the locked and unlocked positions, the pivoting motion involving a change in the plane of the pivoting member relative to the main plane of the deck, and wherein the cam, when the fin is locked in position, is itself locked to the mount.

2. The board according to claim 1, wherein the tongue and groove fit is at a rear end of the fin.

3. The board according to claim 1, wherein the cam includes a member that engages a recess in the fin to lock the fin in place.

4. The board according to claim 1, wherein the member includes a lug that releasably fits into the recess.

5. The board according to claim 1, wherein the cam is locked in position by an interference fit between at least one projection and at least one complementary depression for the or each projection.

6. The board according to claim 5, wherein the, or each, projection is on an edge surface of the pivoting member of the cam and the, or each, complementary depression is on a non-pivoting neighbouring part of the mount.

7. The board according to claim 5, wherein the, or each, depression is located on the edge surface of the pivoting member of the cam and the, or each, complementary projection is located on a non-pivoting neighbouring part of the mount.

8. The board according to claim 1, wherein the plate is spring biased towards the locked position.

9. The board according to claim 2, wherein the cam is located at the opposite end of the mount to where the fin engages in the tongue and groove fit with the mount.

10. A board fin mount comprising a body portion configured to be securable in a cavity in the deck of the board, one or more elongate slots in the body portion each adapted to removably receive the base or one or more base projections of a board fin, means for removably receiving a first end of the base or the, or each, base projection of the fin at one end of the, or each, slot and a cam including a pivoting member, located at another portion of the, or each, slot, adapted to pivot to move between a locked position, to securely lock the base or the, or each, base projection of the fin, to the mount, and an unlocked position where the base or the, or each, base projection of the fin is removable from the mount, wherein the pivotable motion of the pivoting member involves a change in the plane of the pivoting member relative to the plane of the body portion, and wherein the cam, is itself securely lockable to the body portion;

wherein the cam has a plate for application of finger or thumb pressure, or both finger and thumb pressure, which is adapted to cause the plate to pivot between a locked position and an unlocked position for the fin;

wherein the cam is configured to be held in the locked position by an interference fit between at least one projection and at least one complementary depression; and wherein the, or each, depression is on an edge surface of the plate of the cam and configured to receive a complementary projection on a non-pivoting neighbouring part of the body portion.

11. The fin mount according to claim 10, wherein the plate is spring biased towards a locked position.

12. The fin mount according to claim 10 having at one end of the or each slot a tongue configured to removably receive a groove located on the end of the base or on the, or each base projection.

13. The fin mount according to claim 12 wherein the cam is located at the other end of the, or each, slot.

14. The fin mount according to claim 10, wherein the cam includes a lug downwardly depending from the plate and configured to engage with a recess on the end of the fin to lock the fin in the locked position.

15. A fin box for securing a fin in a cavity of a board for use in watersports, the board having a deck with the cavity formed in the deck, the deck defining a main plane, the fin having a fin notch at one end of the fin and a groove at an opposing end of the fin, the fin box comprising:

a body portion having an elongate channel formed therein and configured to receive the fin, the body portion being configured to be positioned in the cavity of the board;

a cam having a pivoting member and a lug, the pivoting member having a pivoting member plate defining a plane of the pivoting member, the pivoting member plate having top surface facing away from the channel, a rearward portion and an opposing forward portion, the cam being capable of a pivoting motion between a locked position and an unlocked position, in the locked position the fin being locked in position and the cam itself being locked in position relative the fin box, in the unlocked position the fin being releasable from the fin box, the pivoting member plate can be pressed by a finger or thumb in a direction into the cavity to pivot the pivoting member plate to move in a pivoting motion between the locked and unlocked positions where the fin is and is not secured in the fin box, the pivoting motion involving a change of orientation of the plane of the pivoting member relative to the main plane of the deck, the lug extending into the channel from the plate and being configured to engage the fin notch with the cam in the locked position; and a tongue extending in the channel towards the cam and being configured to engage the groove with the fin box in a releasable fit, the rearward portion extending toward the tongue and the opposing forward portion extending away from the tongue.

16. The fin box of claim 15 the rearward portion can be pressed by a finger or thumb in a direction into the cavity to pivot the pivoting member plate to move in a pivoting motion to the unlocked position where the fin is not secured in the fin box, the forward portion can be pressed by a finger or thumb in a direction into the cavity to pivot the pivoting member plate to move in a pivoting motion to the locked position where the fin is secured in the fin box.

* * * * *